US008935943B2

(12) United States Patent
Derman

(10) Patent No.: US 8,935,943 B2
(45) **Date of Patent: *Jan. 20, 2015**

(54) APPARATUS FOR SECURING A PORTABLE ELECTRONIC DEVICE

(71) Applicant: Jay S Derman, Temecula, CA (US)

(72) Inventor: Jay S Derman, Temecula, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/297,512

(22) Filed: Jun. 5, 2014

(65) Prior Publication Data

US 2014/0346311 A1 Nov. 27, 2014

Related U.S. Application Data

(63) Continuation-in-part of application No. 13/466,633, filed on May 8, 2012, now Pat. No. 8,783,073.

(51) Int. Cl.
*E05B 73/00* (2006.01)
*H01R 13/46* (2006.01)
*H01R 13/639* (2006.01)

(52) U.S. Cl.
CPC ..... *E05B 73/0011* (2013.01); *H01R 13/46* (2013.01); *H01R 13/639* (2013.01)
USPC ..... 70/14; 70/15; 70/57; 70/58; 70/209; 248/551

(58) Field of Classification Search
CPC ..... E05B 73/00
USPC ..... 70/14, 57, 58, 209, 15; 248/551–553; 439/133, 134, 367–370, 373
See application file for complete search history.

(56) References Cited

U.S. PATENT DOCUMENTS

| | | | | | |
|---|---|---|---|---|---|
| 4,585,202 | A * | 4/1986 | Parsekian | 248/553 |
| 4,674,813 | A * | 6/1987 | Feldner | 439/133 |
| 5,174,293 | A * | 12/1992 | Hagiwara | 600/300 |
| 5,348,495 | A * | 9/1994 | Kasden | 439/371 |
| RE35,677 | E * | 12/1997 | O'Neill | 248/551 |
| 6,159,034 | A * | 12/2000 | Royer | 439/373 |
| 6,276,952 | B1 * | 8/2001 | Ferranti et al. | 439/345 |
| 6,308,928 | B1 * | 10/2001 | Galant | 248/553 |
| 6,443,417 | B2 * | 9/2002 | Galant | 248/553 |
| 6,763,688 | B1 * | 7/2004 | Syu | 70/14 |
| 6,763,690 | B2 * | 7/2004 | Galant | 70/58 |
| 7,007,912 | B1 * | 3/2006 | Giuliani et al. | 248/552 |
| 7,028,513 | B2 * | 4/2006 | Avganim | 70/18 |
| 7,056,145 | B2 * | 6/2006 | Campbell et al. | 439/373 |
| 7,174,752 | B2 * | 2/2007 | Galant | 70/58 |
| 7,204,106 | B2 * | 4/2007 | Merrem et al. | 70/14 |
| 7,324,333 | B2 * | 1/2008 | Allen | 361/679.55 |
| 7,549,308 | B2 * | 6/2009 | Avganim | 70/58 |

(Continued)

*Primary Examiner* — Suzanne Barrett
(74) *Attorney, Agent, or Firm* — Aaron P. McGushion

(57) ABSTRACT

A securement device is provided to secure a portable item from unauthorized movement or theft. A first bracket engages a first portion of the item, second bracket engages a second portion of the item, and an elongated member spans the portable item to attach the first bracket to the second bracket to prevent significant separation of the first and second brackets when in the secured configuration. An aperture or recess in the second bracket receives a plug or attached device, where the plug or attached device is plugged into a receptacle in the item. When the attached device or plug is situated within the aperture or recess in the first bracket and the first bracket is engaged to the item, the first bracket is prevented from lateral and rotational movement relative to the item. A lock may be attached to the securement device to secure the item to an anchor.

17 Claims, 11 Drawing Sheets

(56) References Cited

U.S. PATENT DOCUMENTS

| | | | | |
|---|---|---|---|---|
| 7,658,363 | B2 * | 2/2010 | Meyer | 248/551 |
| 7,866,623 | B2 * | 1/2011 | Lampman et al. | 248/551 |
| 8,061,164 | B2 * | 11/2011 | Johnston et al. | 70/58 |
| 8,191,851 | B2 * | 6/2012 | Crown | 248/553 |
| 8,276,872 | B2 * | 10/2012 | Lampman et al. | 248/551 |
| 8,783,073 | B1 * | 7/2014 | Derman | 70/14 |
| 8,814,128 | B2 * | 8/2014 | Trinh et al. | 248/551 |
| 2011/0070756 | A1 * | 3/2011 | Peckham | 439/133 |
| 2011/0185776 | A1 * | 8/2011 | Mahaffey et al. | 70/58 |
| 2012/0234055 | A1 * | 9/2012 | Bland et al. | 70/15 |
| 2013/0043369 | A1 * | 2/2013 | Wheeler | 248/551 |

* cited by examiner 22
36a
38
66
54
40
72
36b 22
36a
66
68
69
72
54
36b 22
40
70
72
54

θ
22
74
90
92
70
66
54
72

90
66
92
90
70

92
66
90
70

APPARATUS FOR SECURING A PORTABLE ELECTRONIC DEVICE

RELATED APPLICATION DATA

This application is a continuation-in-part of co-pending U.S. patent application Ser. No. 13/466,633, filed on May 8, 2012, which claims benefit from U.S. Provisional Application for Patent Application No. 61/620,036 filed Apr. 4, 2012, which both are hereby incorporated by reference.

BACKGROUND

This invention relates to security systems and, more particularly, to novel systems and methods for securing personal property.

As computers, expensive electronic equipment, and other valuable portable articles have become more common, theft of such articles has increased. There are a number of different devices on the market to deter such theft. However, most of these devices are not well suited to many modem electronics that are relatively small and thin and lack built-in securement mechanisms. Accordingly, what is needed is an improved system and method for securing valuable portable articles.

BRIEF SUMMARY OF THE INVENTION

In view of the foregoing, in accordance with the invention as embodied and broadly described herein, a method and apparatus are disclosed in one embodiment of the present invention as including a system protecting an item from theft, unwanted removal, unauthorized use, or the like. In selected embodiments, a system may include a securement device and a lock. A securement device may include an elongated member, a first bracket, and a second bracket. A first bracket may connect to a first end of an elongated member and extend to engage or bracket a first portion of the perimeter of a corresponding item. A second bracket may selectively connect to a second end of the elongated member and extend to engage or bracket a second (e.g., opposite) portion of the perimeter. A lock (e.g., a lock marketed under the CLICKSAFE or MICROSAVER trademark by Kensington Computer Products Group) may then engage the second end of the elongated member and hold the second bracket in engagement with the item.

In selected embodiments, a system may include a tether. A tether may complete a link between an item and some anchor. For example, a tether may secure to a lock and extend therefrom to engage an anchor (e.g., a post, desk, table, or the like). Alternatively, a tether may be omitted. That is, a user may simply desire to maintain an item in a compacted, closed, or unusable configuration. In such embodiments, both a tether and an anchor may be omitted.

First and second brackets may engage an item in any suitable manner. In selected embodiments, one or more brackets may include one or more extensions extending to contain or block certain motion between a bracket and an item. For example, a bracket may include a top extension, bottom extension, and back portion collectively forming or defining a cavity for receiving an edge or other portion of an item therewithin. A cavity may be sized and shaped to closely track or follow the contours of a corresponding edge or portion of an item. Alternatively, a cavity may have a more generic shape that properly receives or engages an edge or portion of an item, but does not match the exact shape thereof.

In selected embodiments, a first bracket may be fixed with respect to an elongated member, while a second bracket may selectively move through a range of motion with respect to the elongated member. By increasing the distance between the first and second brackets, a securement device may be opened to receive an item therewithin. Conversely, by advancing the second bracket along the elongated member toward the first bracket, a securement device may be closed and an item may be engaged or gripped therewithin. A lock may then be applied to secure the second bracket in a locked position, thereby limiting the ability of an unauthorized user to remove the securement device from the item.

In an alternate embodiment, a securement device is provided for securing an item having a first portion and a second portion. The item also has a receptacle on the first portion for receiving in electrical contact a plug. The device comprises a first bracket, a second bracket, and a connecting member or elongated member. The first bracket has a wall with a plug aperture formed through the wall and a plug blocking portion located about at least a portion of a perimeter of the plug aperture. The connecting member selectively connects the first bracket to the second bracket.

In a secured configuration, the plug is inserted into the receptacle, the first bracket is engaged with the first portion and the second bracket is engaged with the second portion, the connecting member extends across the item to connect the first bracket to the second bracket, the connecting member preventing substantial separation of the first bracket from the second bracket. The plug is prevented from being fully retracted from the receptacle due to being blocked by the plug blocking portion.

In an alternate embodiment, a securement device comprises a first bracket having a wall with an inner surface and a plug recess formed on the inner surface with the plug recess having a bottom, a second bracket, and a connecting member for selectively connecting the first bracket to the second bracket. In a secured configuration, the plug is inserted into the receptacle, the first bracket is engaged with the first portion and the second bracket is engaged with the second portion, the connecting member extends across the item to connect the first bracket to the second bracket, the connecting member preventing substantial separation of the first bracket from the second bracket. The plug body is received within the plug recess in the secured configuration and is prevented from being fully retracted from the receptacle due to being blocked by the plug bottom.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
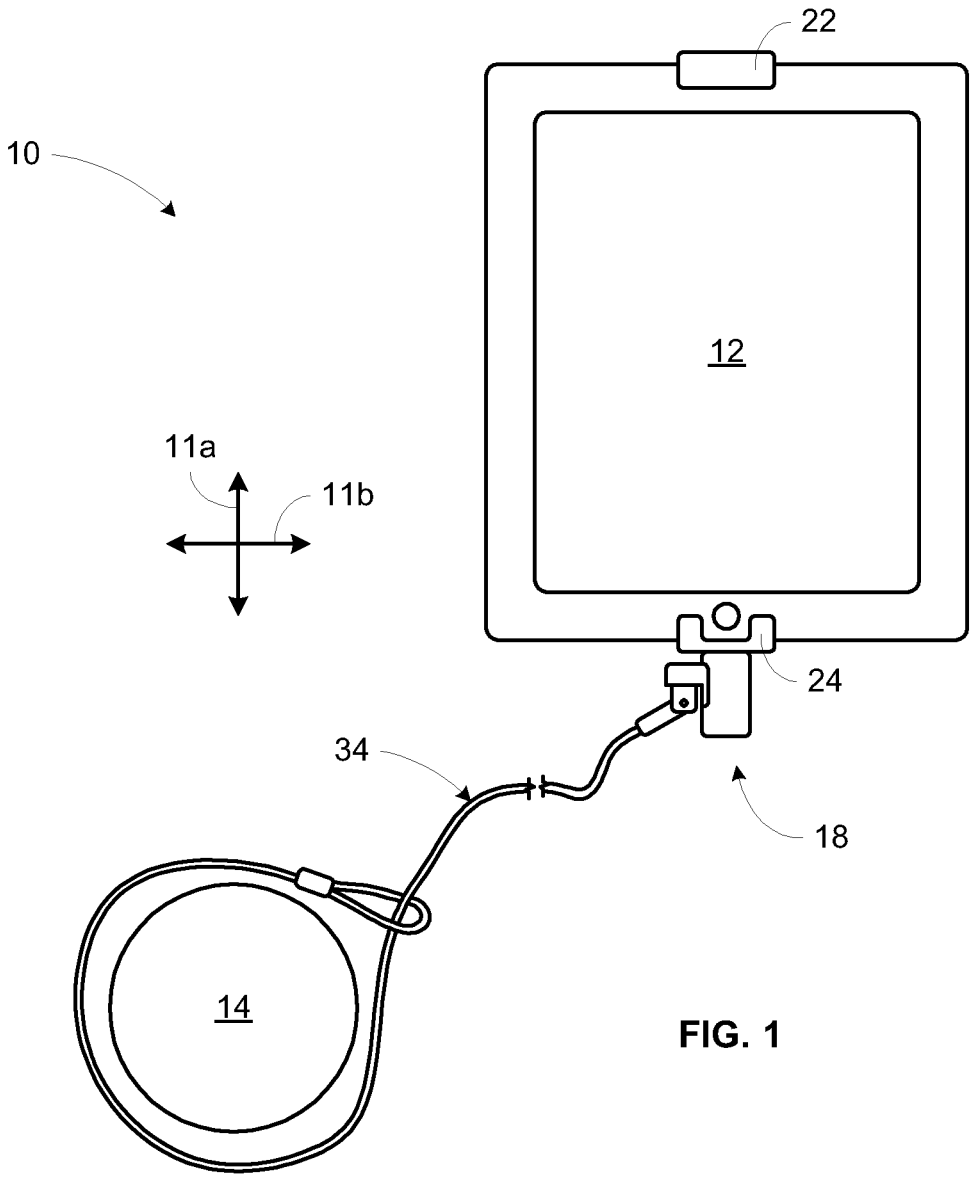
FIG. 1 is a top view of one embodiment of a system for engaging an item and tethering the item to an anchor in accordance with the present invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Figure 2:
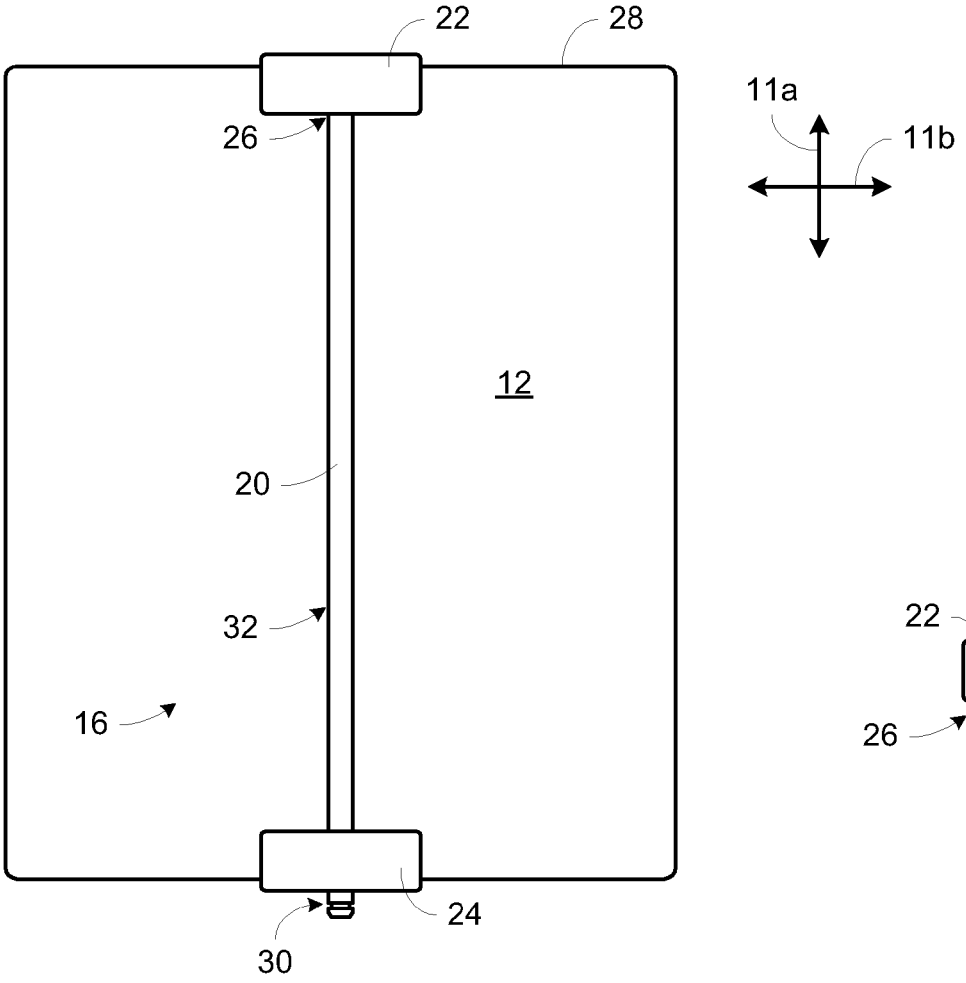
FIG. 2 is a bottom view of the securement device and item of FIG. 1.
Figure 3:
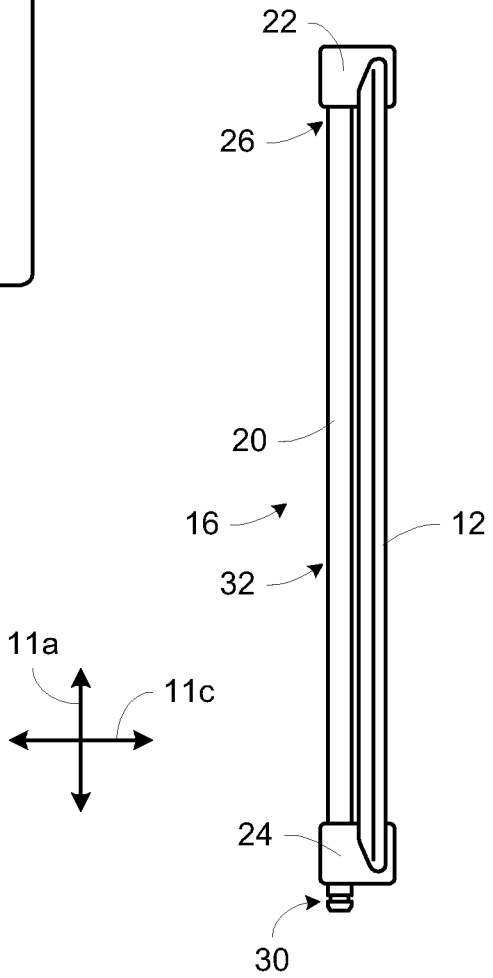
FIG. 3 is a side view of the securement device and item of FIG. 1.

Referring to FIGS. 1-3, in discussing a system 10 in accordance with the present invention, it may be helpful to first establish a coordinate system. Accordingly, in certain embodiments, a system 10, or one or more components thereof, may be described in terms of a three-dimensional coordinate system comprising longitudinal 11*a*, lateral 11*b*, and transverse 11*c* directions.

A system 10 in accordance with the present invention may protect an item 12 (e.g., valuable portable article, computer monitor, laptop computer, touch-screen tablet, cellular telephone, or the like) from theft, unwanted removal, unauthorized use, or the like. This may be accomplished by binding or securing an item 12 in a manner that resists use or removal of the item 12 (e.g., securing a laptop in a closed configuration, etc.). Alternatively, or in addition thereto, a system 10 may protect an item 12 by tethering or otherwise connecting an item 12 to an anchor 14.

An anchor 14 may be an object that is substantially fixed in place (e.g., an embedded post or the like). Alternatively an anchor 14 may be an object sufficiently heavy, bulky, or both to rendering moving the object unpractical or undesirable. For example, an anchor 14 may comprise a desk, table, or the like that may be moved or dismembered, but only with significant effort or with the generation of unwanted attention from surrounding individuals.

In selected embodiments, a system 10 in accordance with the present invention may include a securement device 16 and a lock 18. A securement device 16 may include one or more mechanisms for contacting and engaging (e.g., securing, holding, bracketing) an item 12. A lock 18 may engage a securement device 16 to maintain a secure connection between the securement device 16 and the corresponding item 12.

For example, in certain embodiments, a securement device 16 may include an elongated member 20, a first bracket 22, and a second bracket 24. A first bracket 22 may fixedly connect to a first end 26 of an elongated member 20 and extend to engage or bracket a first portion of the perimeter 28 of a corresponding item 12. A second bracket 24 may movably connect to a second end 30 of the elongated member 20 and extend to engage or bracket a second (e.g., opposite) portion of the perimeter 26. A lock 18 may then engage the second end 30 of the elongated member 20 and hold the second bracket 24 in engagement with the item 12.

An elongated member 20 may be substantially inextensible. That is, stretching or elongation of an elongated member 20 may only be accomplished with significant force (e.g., more force than can be applied by hand, without the aid of tools). Accordingly, once a securement device 16 is applied to an item 12, and a lock 18 is applied to the securement device 16, then first and second brackets 22, 24 may be properly spaced to secured an item 12 therebetween.

In selected embodiments, an elongated member 20 may be flexible. For example, an elongated member 20 may be formed of or comprise a section of chain, cable formed of stands of metal wire, or the like. Alternatively, or in addition thereto, an elongated member 20 may be formed of or comprise one or more sections of substantially rigid material. For example, one or more ends (e.g., a second end 30) of an elongated member 20 may be formed of rigid material (e.g., cylindrical material or the like), while an intermediate portion 32 may comprise something flexible (e.g., chain, cable, rope, or the like). In still other embodiments, an entire elongated member 20 may be formed of rigid material. For example, an elongated member 20 may comprise a rod (e.g., a round or polygonal cylinder, bar, or the like) of material, flat strip of material, or the like.

When applied to an item 12, an elongated member 20 may have any suitable orientation. For example, selected items 12 (e.g., cellular telephones, tablet computers, laptop computers, etc.) may be generally rectangular in shape and have a length extending in the longitudinal direction 11*a* and a width extending in the lateral direction 11*b*. For such items 12, an elongated member 20 may extend in the longitudinal direction 11*a*, while the first and second brackets 22, 24 engage or bracket the top and bottom ends or edges of the item 12. Alternatively, the elongated member 20 may extend in the lateral direction 11*a*, while the first and second brackets 22, 24 engage or bracket the left and right sides or edges of the item 12.

An elongated member 20 may have any suitable shape. For example, selected items 12 (e.g., cellular telephones, tablet computers, laptop computers, etc.) may be generally thin and flat. For such items 12, an elongated member 20 may be extend in a line from a first bracket 22 to a second bracket 24. Alternatively, an elongated member 20 may curve or extend in a manner that is not straight. Such shapes may be included for aesthetics, to accommodate or follow the shape of an item 12, or some combination thereof.

In selected embodiments, a system 10 may include a tether 34. A tether 34 may complete a link between an item 12 and an anchor 14. A tether 34 may comprise chain, cable, rope, or the like. In selected embodiments, a tether 34 may secure to a lock 34 (e.g., engage or loop through or around a shackle of a lock 18) and extend therefrom to engage (e.g., loop through or around) an anchor 14.

A lock 18 in accordance the present invention may have any suitable form. The form of the lock 18 may vary depending on the configuration of a securement device 16 or components thereof. In certain embodiments, a lock 18 or a lock 18 and tether 34 combination and may be configured as or comprise a device currently being sold by Kensington Computer Products Group under the CLICKSAFE trademark. In other embodiments, a lock 18 may comprise a padlock. In still other embodiments, a system 10 in accordance with the present invention may utilize other kinds of locks 18.

In certain embodiments, a tether 34 may be omitted. For example, in selected embodiments, a securement device 16 and lock 18 may be all the security necessary or desired. That is, a user may simply desire to maintain an item 12 in a compacted, closed, or unusable configuration, not to tether the item 12 to an anchor 14. In such embodiments, both a tether 34 and an anchor 14 may be omitted from a system 10 in accordance with the present invention.

The various components of a system 10 in accordance with the present invention may be formed of any suitable materials. Suitable materials may be selected to provide a desired durability, strength, rigidity, toughness, or the like. For example, in selected embodiments, one or more of the components of a system 10 may be formed of a polymeric material. However, in other embodiments where greater stresses are expected, such components may be formed of a metal or metal alloy.

One or more components 16, 18, 20, 22, 24, 34 of a system 10 may be coated or covered partially or completely with one or more protective materials (e.g., polymeric materials). Such materials may facilitate handling of the components, protect the components, prevent unwanted abrasion or damage of an item 12, or the like. Additionally, certain such materials may enable one or more brackets 22, 24 to better grip and secure an item 12.

Figure 4:
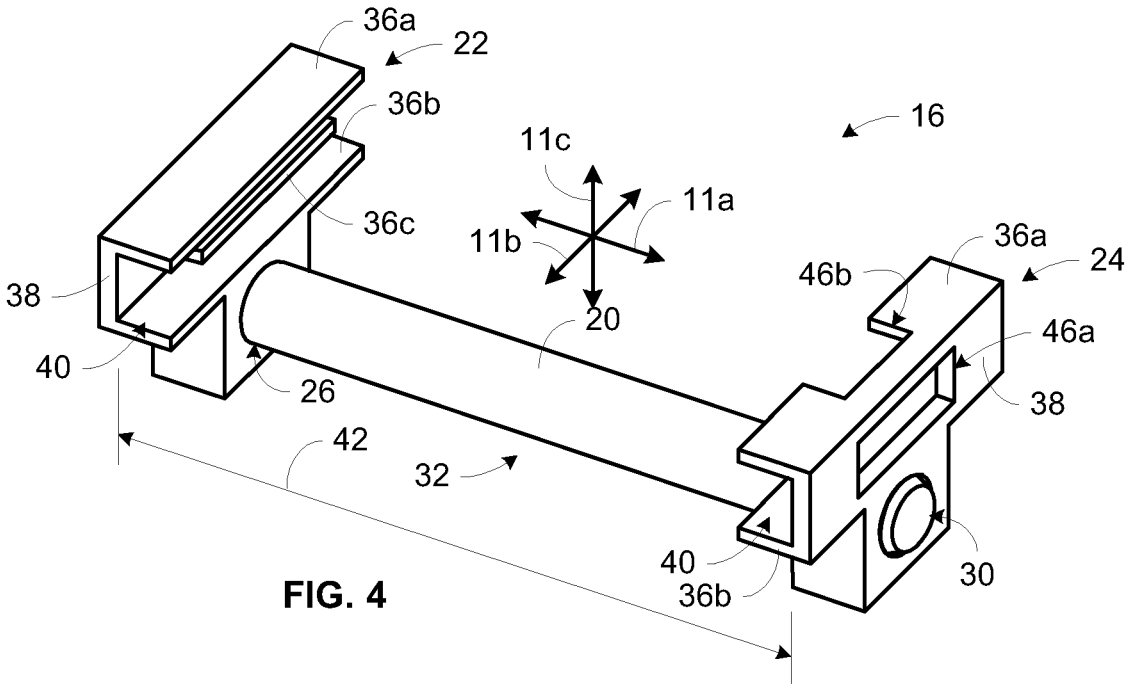
FIG. 4 is a perspective view of one embodiment of a securement device in an "open" configuration wherein the securement device is ready to receive an item therewithin in accordance with the present invention.
Figure 5:
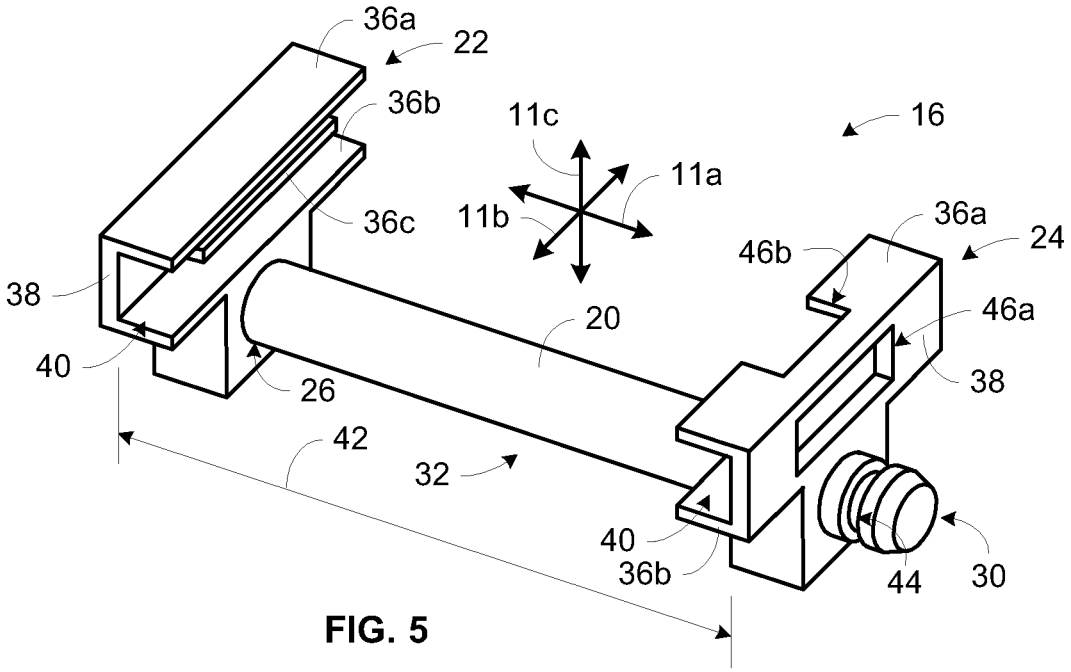
FIG. 5 is a perspective view of the securement device of FIG. 4 transitioned to a "closed" configuration wherein the securement device would engage an item had one been installed therewithin.

Referring to FIGS. 4 and 5, brackets 22, 24 in accordance with the present invention may engage an item 12 in any suitable manner. In general, a bracket 22, 24 may engage an item 12 and resist relative motion with respect thereto in the lateral and transverse 11*b*, 11*c* directions. Two brackets 22, 24, held together by an elongated member 20, may cooperate to resist relative motion with respect to an item 12 in the longitudinal directions 11*a*. Suitable engagement mechanisms between a bracket 22, 24 and an item 12 may include frictional engagement, mechanical interference, mechanical abutment, or the like or combinations or sub-combinations thereof.

First and second brackets 22, 24 may have any suitable size and shape. In selected embodiments, the shape and size may be selected to fit (or support engagement with) a particular item 12, a group of items 12 having similarly dimensions, certain accessories associated with an item 12 (e.g., protective covers), or the like. For example, one or more brackets 22, 24 may include one or more extensions 36 extending to contain or block certain motion between a bracket 22, 24 and an item 12.

In certain embodiments, a bracket 22, 24 may include a top extension 36*a*, a bottom extension 36*b*, or some combination thereof that extends to engage or bracket an edge or other portion of an item 12, thereby containing relative motion in the transverse direction 11*b*. For example, one or more brackets 22, 24 may include a top extension 36*a*, a bottom extension 36*b*, and back portion 38 collectively forming or defining a cavity 40 for receiving an edge or other portion of an item 12 therewithin.

A cavity 40 may be sized and shaped to closely track or follow the contours of a corresponding edge or portion of an item 12. Such tracking may be of the item 12 itself or of some protective sleeve, cover, or case placed over an item 12.

Alternatively, a cavity 40 may have a more generic shape (e.g., a rectangular shape) that properly receives or engages an edge or portion of an item 12, but does not match the exact shape thereof.

Alternatively, or in addition thereto, a bracket 22, 24 may include an extension 36*c* extending to engage some aperture of an item 12. That is, an item 12 may have one or more apertures formed therein. For example, a tablet computer (e.g., IPAD), cellular telephone, or the like may have an aperture or receptacle for receiving the plug of a charger or USB cable, an aperture or "jack" for receiving the plug of an earpiece or headphone, or the like. Accordingly, an extension 44 may extend into such an aperture. This engagement may limit or resist relative motion between a bracket 22, 24 and an item 12 in the lateral and transverse directions 11*b*, 11*b*.

In selected embodiments, one bracket (e.g., a first bracket 22) may be fixed with respect to an elongated member 20, while another (e.g., a second bracket 24) may selectively move through a range of motion with respect to the elongated member 20. By adjusting or changing the position of a second bracket 24 with respect to an elongated member 20, a user may control a distance 42 between a first bracket 22 and the second bracket 24. With no lock 18 secured in place, a second bracket 24 may be free to move to increase the distance 42 between the first and second brackets 24 (e.g., free to "open" the securement device 16). In an open configuration, a securement device 16 may receive an item 12 therewithin or be applied to an item 12. Once the item 12 is positioned between or within the first and second brackets 22, 24, the second bracket 24 may be advanced along the elongated member 20 toward the first bracket 22. Such "closing" motion may continue until the first and second bracket 22, 24 have fully engaged the item 12, at which time the second bracket 24 may be said to occupy an engaged or locked position. A lock 18 may then be applied to secure the second bracket 24 in the locked position, thereby limiting the ability of an unauthorized user to remove the securement device 16 from the item 12.

In certain embodiments, the length of an elongated member 20 and the engagement thereof by a lock 18 may be configured to hold first and second brackets 22, 24 firmly against an item 12. That is, in a locked position, the first and second brackets 22, 24 may apply a compressive force to an item 12. This may be helpful when a frictional engagement factors into the ability of the brackets 22, 24 to engage and secure an item 12. Alternatively, a lock 18 may simply block a securement device 16 from opening and not apply any compressive force to an item 12.

The length of an elongated member 20, the dimensions of the brackets 22, 24, the location at which a lock 18 engages a securement device 16, and the like may be selected and balanced to fit a particular item 12 or group of items 12. However, it certain embodiments, it may be desirable to finely adjust a securement device 16 to fit an item 12 in a particular way or to fit a variety of items 12 that vary in certain dimensions.

Accordingly, in selected embodiments, a securement device 16 may include one or more spacers (e.g., washers, collars, or the like) that may be positioned on or around an elongated member 20 between a second bracket 24 and a lock 18. By controlling the dimensions of such spacers, the distance 42 between first and second brackets 22, 24 in the locked position may be tailored to fit a particular application or item 12. In certain embodiments, one or more spacers may be elastomeric or spring-like and assist in removing unwanted rattle or play between a securement device 16 and an item 12 or in applying a desired compressive force to an item 12.

In selected embodiments, a second end 30 of an elongated member 12 may provide a mechanism through which a lock 18 may secure a second bracket 24 in an engaged or locked position. A second end 30 in accordance with the present invention may have any suitable configuration. In certain embodiments, a second end 30 may be configured as an anchor disclosed in U.S. Pat. No. 6,081,974 issued Jul. 4, 2000, U.S. Pat. No. 6,317,936 issued Nov. 20, 2001, or U.S. Pat. No. 6,360,405 issued Mar. 26, 2002, each of which is hereby incorporated by reference.

Alternatively, a second end 30 may be configured as an attachment device disclosed in U.S. Pat. No. 7,997,106 issued Aug. 16, 2011 or U.S. Pat. No. 8,001,812 issued Aug. 23, 2011, both of which are hereby incorporated by reference. In still other embodiments, a second end 30 may be configured as or include an interface mechanism disclosed in U.S. patent application Ser. No. 13/216,076 filed Aug. 23, 2011, which is hereby incorporated by reference.

A second end 30 of an elongated member 20 may include one or more mechanisms or structures enabling a lock 18 to engage therewith. For example, a second end 30 may include a locking groove 44 enabling a lock 18 to selectively grip an elongated member 20. In certain embodiments, a locking groove 44 may extend circumferentially about a second end 30. Such a locking groove 44 may enable a lock 18 to pivot about the corresponding end 30, while maintaining a secure engagement therewith. In certain embodiments, to engage a second end 30, a lock 18 may be configured as or comprise a device disclosed in U.S. Pat. No. 6,081,974, U.S. Pat. No. 6,317,936, U.S. Pat. No. 6,360,405, U.S. Pat. No. 7,997,106, or U.S. Pat. No. 8,001,812. For example, as stated hereinabove, a lock 18 or a lock 18 and tether 34 combination and may be configured as or comprise a device currently being sold by Kensington Computer Products Group under the CLICKSAFE trademark.

In selected embodiments, a lock 18 may operate in conjunction with or include one or more of the devices disclosed in U.S. patent application Ser. No. 13/270,439 filed Oct. 11, 2011, U.S. patent application Ser. No. 13/355,328 filed Jan. 20, 2012, U.S. patent application Ser. No. 13/438,147 filed Apr. 3, 2012, U.S. Pat. No. 5,992,187 issued Nov. 30, 1999, U.S. Pat. No. 6,159,025 issued Dec. 12, 2000, and U.S. Pat. No. 6,793,081 issued Sep. 21, 2004, each of which is hereby incorporated by reference.

A bracket 22, 24 in accordance with the present invention may include one or more openings 46 (e.g., apertures, slots, or the like). Such openings 46 may be strategically located to provide access to certain portions, ports, or controls of an item 12. For example, one opening 46*a* may provide access to a headphone jack, speaker, or the like, while another opening 46*b* may provide access to a button. Alternative, or in addition thereto, a bracket 22, 24 may block access to certain portions, ports, or controls of an item 12. For example, rather than having an opening 46*b* exposing a button, a bracket 22, 24 may have an extension blocking access to the button. Thus, when installed, a securement device 16 in accordance with the present invention may block certain uses or operations of an item 12.

Figure 6:
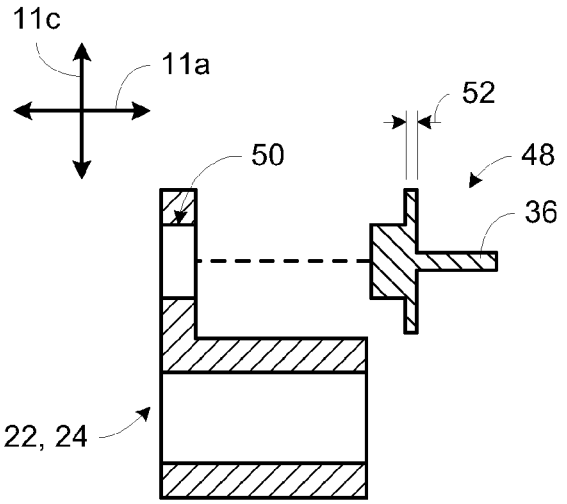
FIG. 6 is a cross-sectional, exploded view of one embodiment of a bracket and insert in accordance with the present invention.
Figure 7:
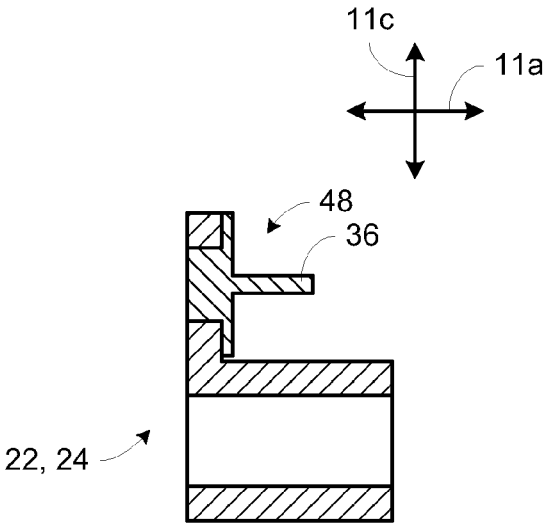
FIG. 7 is a cross-sectional, assembled view of the bracket and insert of FIG. 6.
Figure 8:
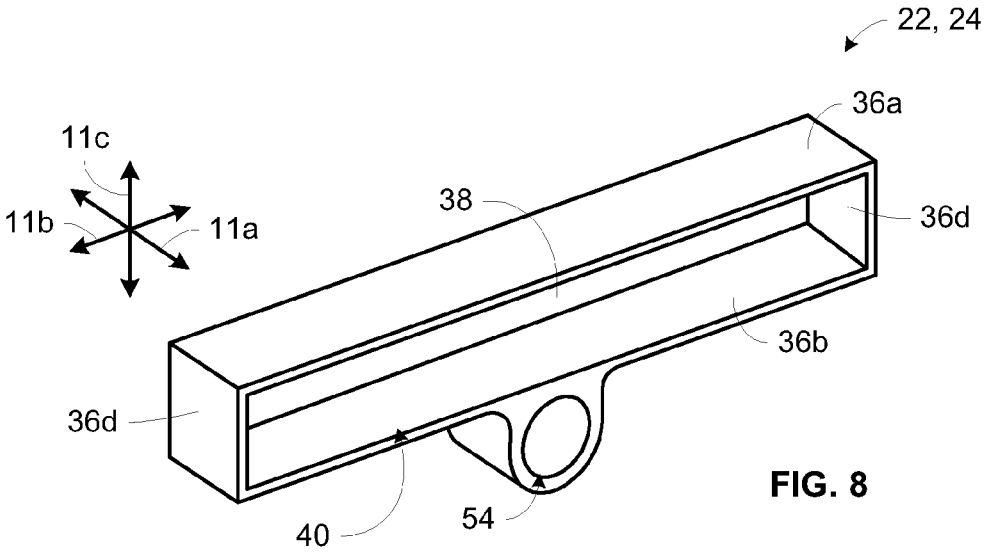
FIG. 8 is a perspective view of an alternative embodiment of a bracket in accordance with the present invention.
Figure 9:
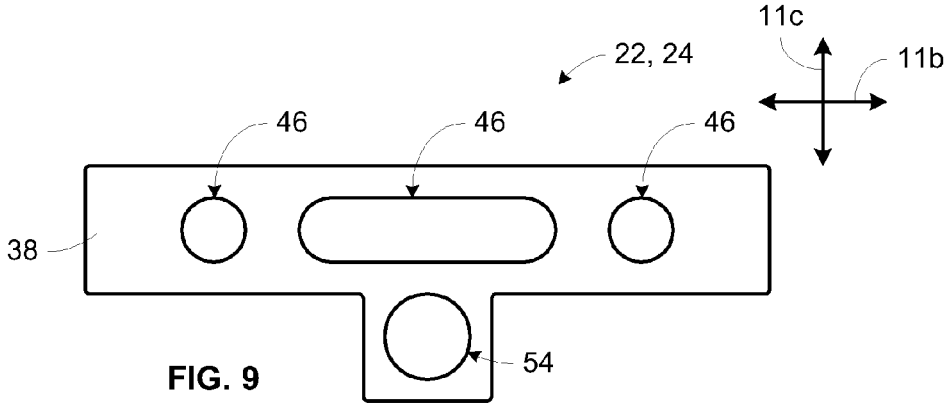
FIG. 9 is a back elevation view of an alternative embodiment of a bracket in accordance with the present invention.
Figure 10:
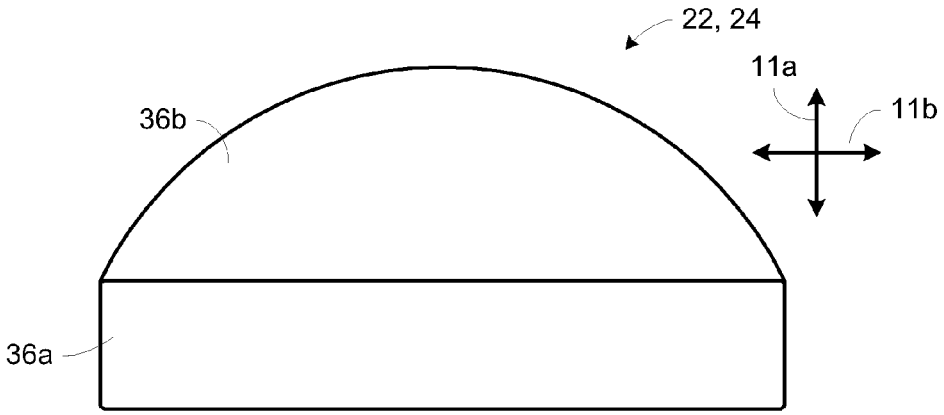
FIG. 10 is a top plan view of the bracket of FIG. 9.
Figure 11:
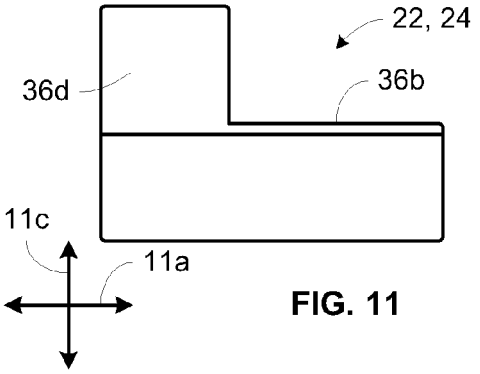
FIG. 11 is an elevation view showing a side extension that may be included within the bracket of FIG. 9.
Figure 12:
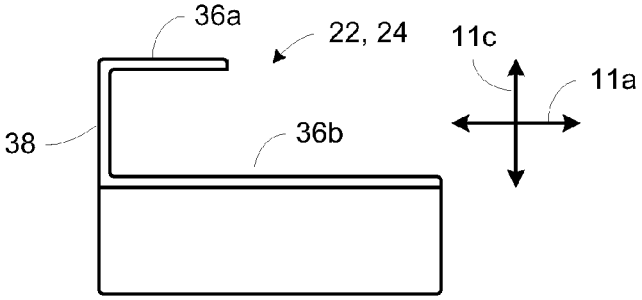
FIG. 12 is an elevation view showing the bracket of FIG. 9 without a side extension.
Figure 13:
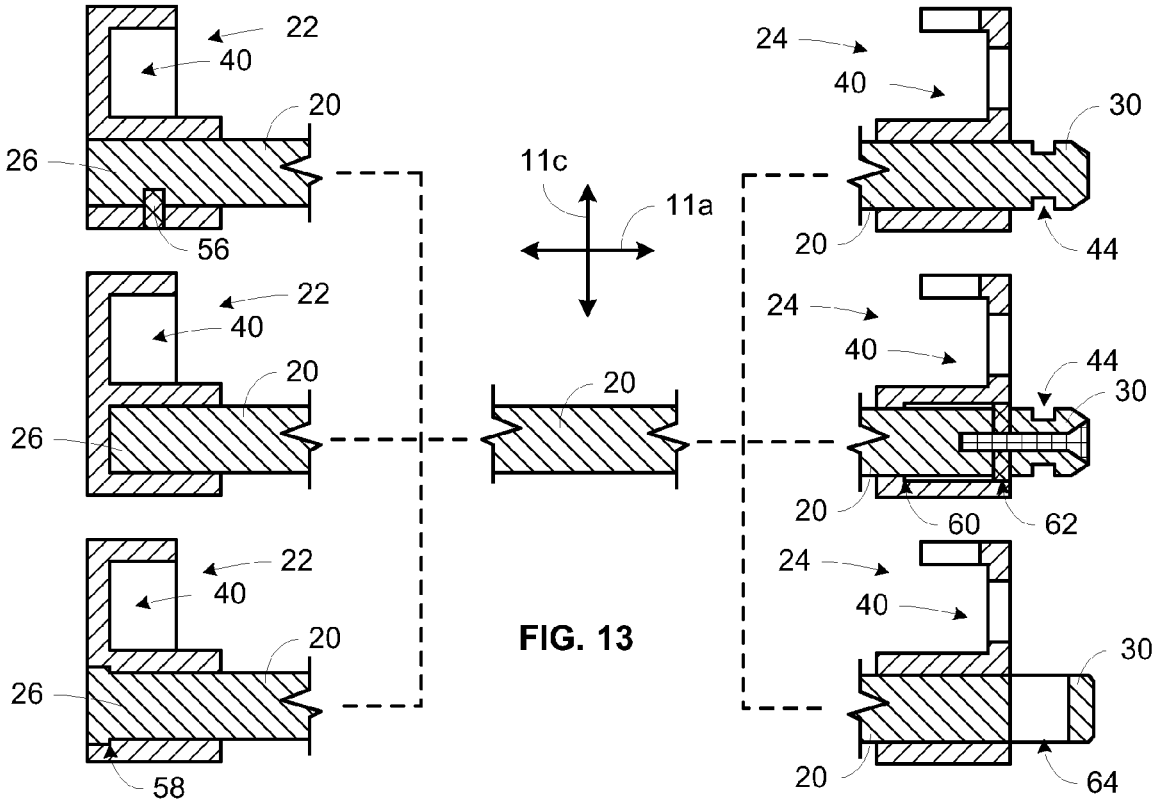
FIG. 13 is a cross-sectional view of various possible combinations of an elongated member and associated first and second brackets in accordance with the present invention.

Referring to FIGS. 6 and 7, in selected embodiments, one or more extensions 36 may be configured as or extend from a removable insert 48. For example, a bracket 22, 24 may include a registration aperture 50. An insert 48 may be removably seated within a registration aperture 50. One or more extensions 36 may then extend from the insert 48 to engage an item 12 or portion thereof. Different inserts 48 may have different dimensions, spacings 52, extensions 36, and the like. Thus, different inserts 48 may be used to adapt a particular bracket 22, 24 (e.g., a bracket 22, 24 of a particular design or configuration) to a variety of items 12.

In certain embodiments, an extension 36 (e.g., an extension 36 located on an insert 48) may form a plug configured to match and engage one or more USB, HDMI, microphone, audio, VGA, or LAN ports or the like. For example, an insert 48 may be configured as a "dummy" USB plug, having the dimensions, extensions, cavities, or the like thereof, but lacking the electrical connectivity of the actual plug.

Referring to FIGS. 8-13, in selected embodiments, a bracket 22, 24 may include one or more extensions 36 forming side walls 36*d*. Side walls 36*d* may abut one or more sides of an item 12 or the sides of something extending from an item 12. For example, in certain embodiments, a bracket 22, 24 may include a top extension 36*a*, bottom extension 36*b*, and opposing side walls 36*d* that collectively form a cavity 40 or pocket for receiving an entire edge or end of an item 12 (e.g., a top or bottom edge of an item 12). Alternatively, a top extension 36*a*, bottom extension 36*b*, and opposing side walls 36*d* may collectively form a smaller cavity 40 or pocket for receiving something extending from an item 12.

A bracket 22, 24 may receive or secure to an elongated member 20 in any suitable manner. Suitable methods of securement may include welding, riveting, pinning, bolting, threading, crimping, press fitting, monolithic formation (e.g., casting, molding, or machining an elongated member 20 and a bracket 22 as a single, seamless unit), or the like or some combination or sub-combination thereof.

In selected embodiments, a bracket 22, 24 may include an aperture 54 for receiving a portion of an elongated member 20. In certain embodiments, a first bracket 22 may include an aperture 54 for receiving a first end 26 of an elongated member 20. A first end 26 may be substantially fixed within such an aperture 54. For example, a pin 56 may be applied to secure a first end 26 within an aperture 54.

Extensions 36 in accordance with the present invention may have any suitable size and shape. For example, in selected embodiments, a bottom extension 36*b* have extend further than one or more other extension 36*a*, 36*d* and have one or more curved or semi-circular edges.

An aperture 54 may be formed as a through hole. Alternatively, an aperture 54 may be closed at one end to form a blind hole. In certain embodiments, a first end 26 of an elongated member 20 may include a shoulder 58 or head 58 sized and shaped to abut a corresponding shoulder of a corresponding first bracket 22. Such embodiments, may provide a one way securement (e.g., a first bracket 22 may move along an elongated member 20 toward a second bracket 24, but may not move off the first end 26). Alternatively, a shoulder 58 or head 58 may be utilized in a press fit embodiment, wherein substantially all relative motion between a first bracket 22 and an elongated member 20 is resisted.

In certain embodiments, a second bracket 24 may include an aperture 54 of sufficient size for the second bracket 24 to selectively slide along an elongated member 20. For example, an aperture 54 of a second bracket 24 may be sized to provide at least a slip fit with respect to a corresponding elongated member 20. A second bracket 24 may be free to slide on and off an elongated member 20. Alternatively, a second bracket 24, elongated member 20, or some combination thereof may provide a mechanism for containing or limiting the motion of a second bracket 24. For example, a second bracket 24 may include a shoulder 60 configured to abut against a corresponding shoulder 62 of an elongated member 20 to prevent the second bracket 24 from being removed therefrom. In selected embodiments, a shoulder 62 corresponding to an elongated member 20 may be selectively removable to enable assembly and disassembly of a securement device 16.

A second end 30 of an elongated member 20 need not include a locking groove 44. For example, in selected embodiments, a second end 30 may include a rather than a locking groove 44. A shackle aperture 64 may be configured to receive the shackle of a lock 18 therewithin. Once a shackle has been inserted and secured within a shackle aperture 64, the shackle may resist certain movement of a second bracket 24. Thus, a second bracket 24 may be secured in a locked position by a pad lock or the like.

Figure 14:
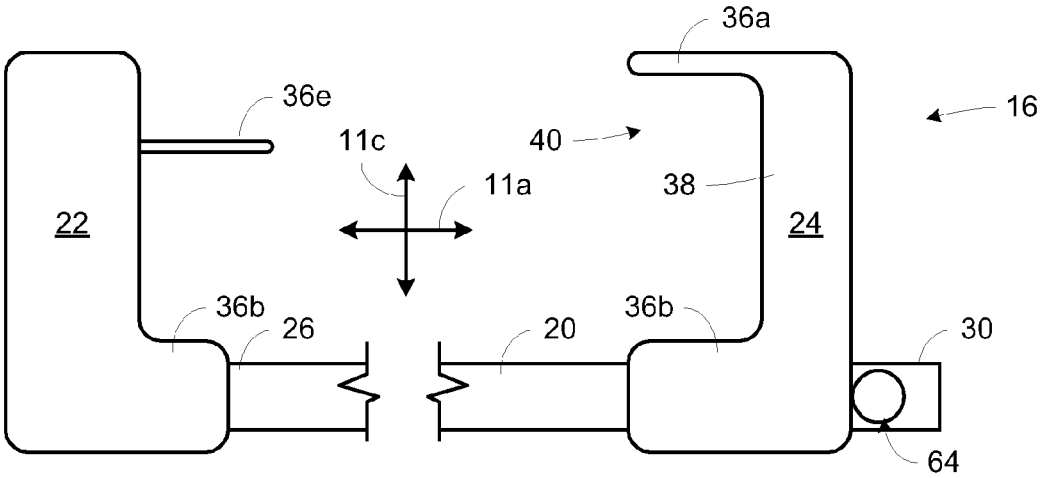
FIG. 14 is a side view of one embodiment of a securement device configured to engage a laptop computer in accordance with the present invention.

Referring to shackle aperture 64 FIG. 14, in certain embodiments, a securement device 16 in accordance with the present invention may include an extension 36 formed or configured as a laptop centering device 36*e*. Such a device 36*e* may prevent a securement device 16 from sliding off an end of a laptop once it has been applied and secured with a lock 18.

A centering device 36*e* may have any suitable configuration. In selected embodiments, a laptop centering device 36*e* may extend between a screen and main body of a laptop at a location between the screen hinges. Once a centering device 36*e* is inserted in place and the securement device 16 is tightened and locked, the centering device 36*e* may prevent the securement device 16 from being slid off the laptop. That is, the hinges of the laptop may limit the side-to-side motion of the centering device 36*e* and the centering device 36*e* may, therefore, limit the side-to-side motion of the securement device 16.

In selected embodiments, a securement device 16 and lock 18 in accordance with the present invention may be used to secure a laptop computer in an open or closed position. In certain such embodiments, a securement device 16 or one or components thereof (e.g., brackets 22, 24) may include an extension 36 configured to engage one or more USB, HDMI, microphone, audio, VGA, or LAN ports or the like. Such ports may enable a securement device 16 (e.g., an elongated member 20) to extend in across the laptop computer in the longitudinal, lateral, or transverse directions 11*a*, 11*b*, 11*c*.

Turning to FIGS. 15-18, an embodiment of the first bracket 22 of the present securement device 16 is illustrated. In FIGS. 15A-B and 16A-B, the first bracket 22 has a top extension or wall 36*a* and a bottom extension 36*b* connected by a back portion or wall 38, which spans between the top wall 36*a* and the bottom wall to define a cavity 40. The sides of the cavity 40 are further defined by the right wall 68 and the left wall 67. The top wall 36*a* and the bottom wall 36*b* preferably extend beyond the right wall 68 and the left wall 67 to create an overhanging arrangement. An aperture 54 receives the second end 30 of the elongated or connecting member 20 in the secured configuration.

A plug aperture 66 is formed through the back wall 38, which permits a portion of the plug 82 or its cable 80 to be inserted through and/or extend through the plug aperture 66. The plug aperture 66 has an edge 92 about at least a portion of the perimeter 96. Blocking portions 90 are formed about the perimeter 96, and may comprise the edge 92 in combination with the back surface 70 of the back wall 38 or one or more protrusions 90 which extend into the plug aperture from the perimeter 96. The blocking portions 90 interact with the plug 82 to mechanically interfere with the plug's 82 removal from the receptacle 84, which is explained in greater detail below.

Figures 15A, 15B, 16A, 16B, 17, 18:
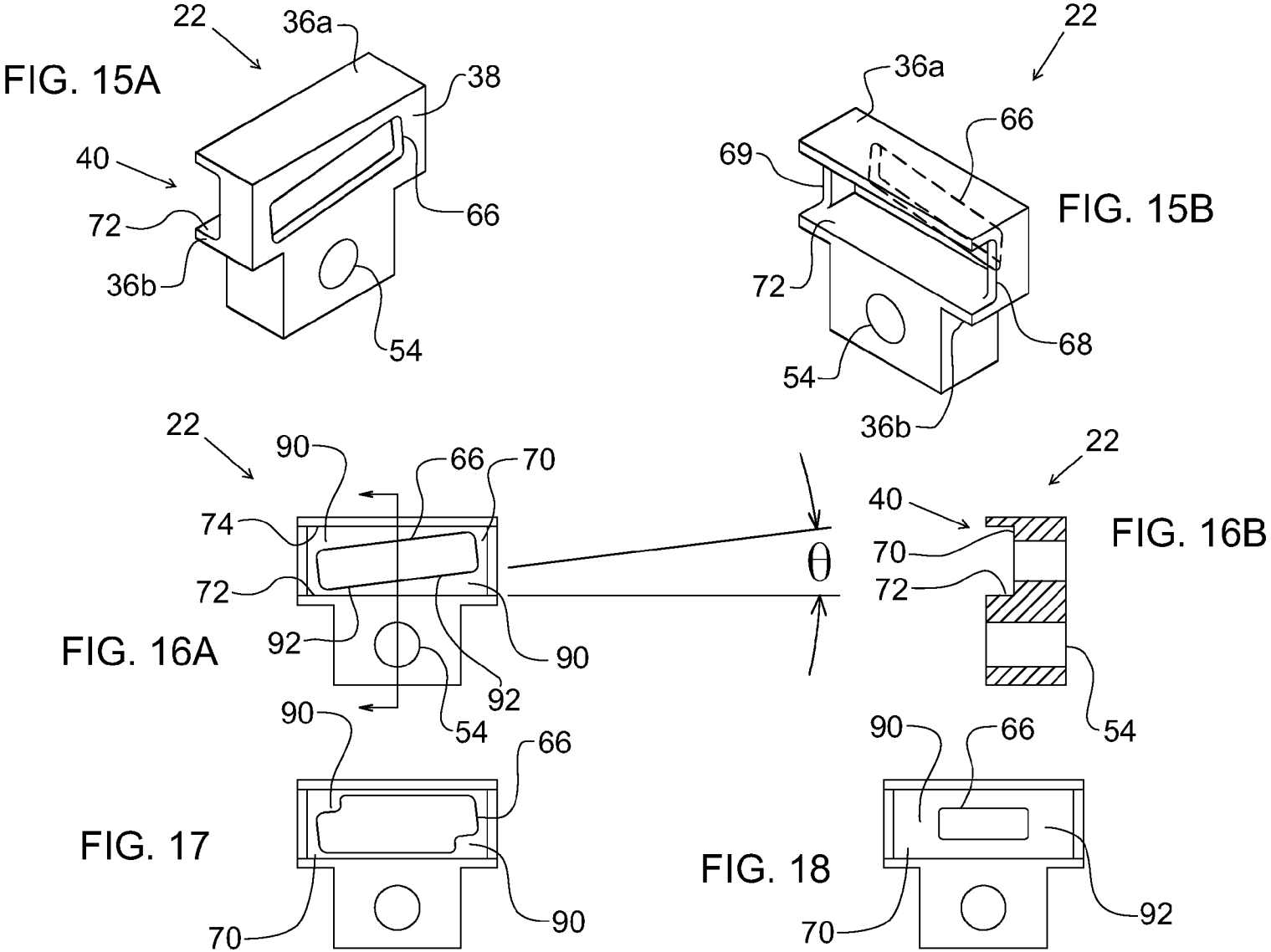
FIGS. 15A-B are front and back perspective views of an alternate embodiment of a securement device.
FIGS. 16A-B are a front plan view and a cross sectional view respectively of the embodiment of FIGS. 15A-B.
FIG. 17 is a front plan view of an alternate embodiment of a securement device.
FIG. 18 is a front plan view of an alternate embodiment of a securement device.

FIG. 16A illustrates an embodiment of the plug aperture 66 shaped as a slot with a perimeter edge 92 angled relative to one or both of the top surface 72 and the bottom surface 74 by an acute or right angle as designated by the angle θ. FIG. 17 illustrates an embodiment with blocking portions 90 created by protrusions extending into the plug aperture 66. FIG. 18 illustrates a relatively smaller plug aperture 66, compared to the embodiments of FIGS. 16 and 17, with the back surface 70 of the back wall 38, at the perimeter 96, acting as a blocking portion 90.

Figure 19:
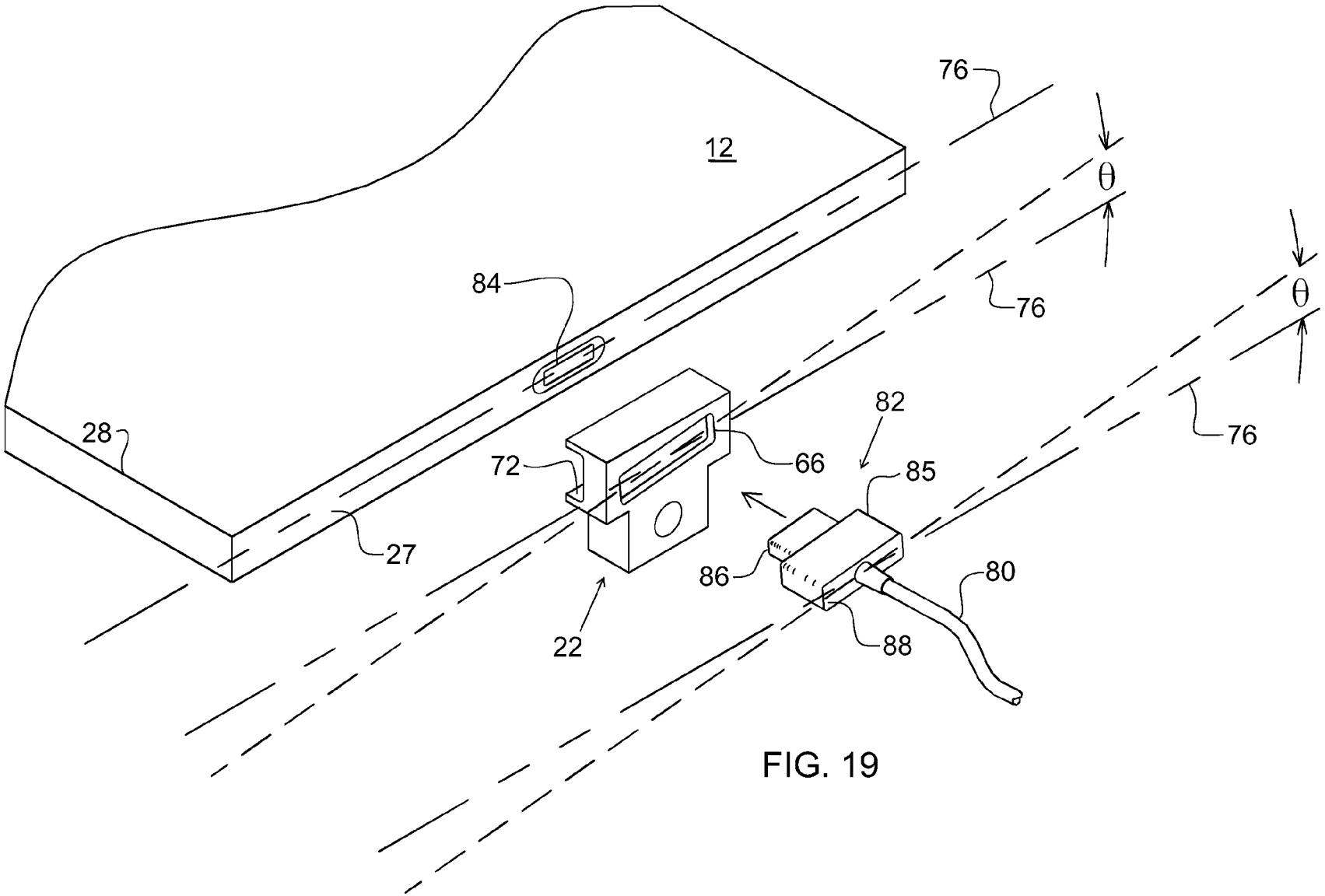
FIG. 19 is an exploded perspective view of the embodiment of FIGS. 15A-B, showing the securement device in position for engagement to a device.
Figure 20:
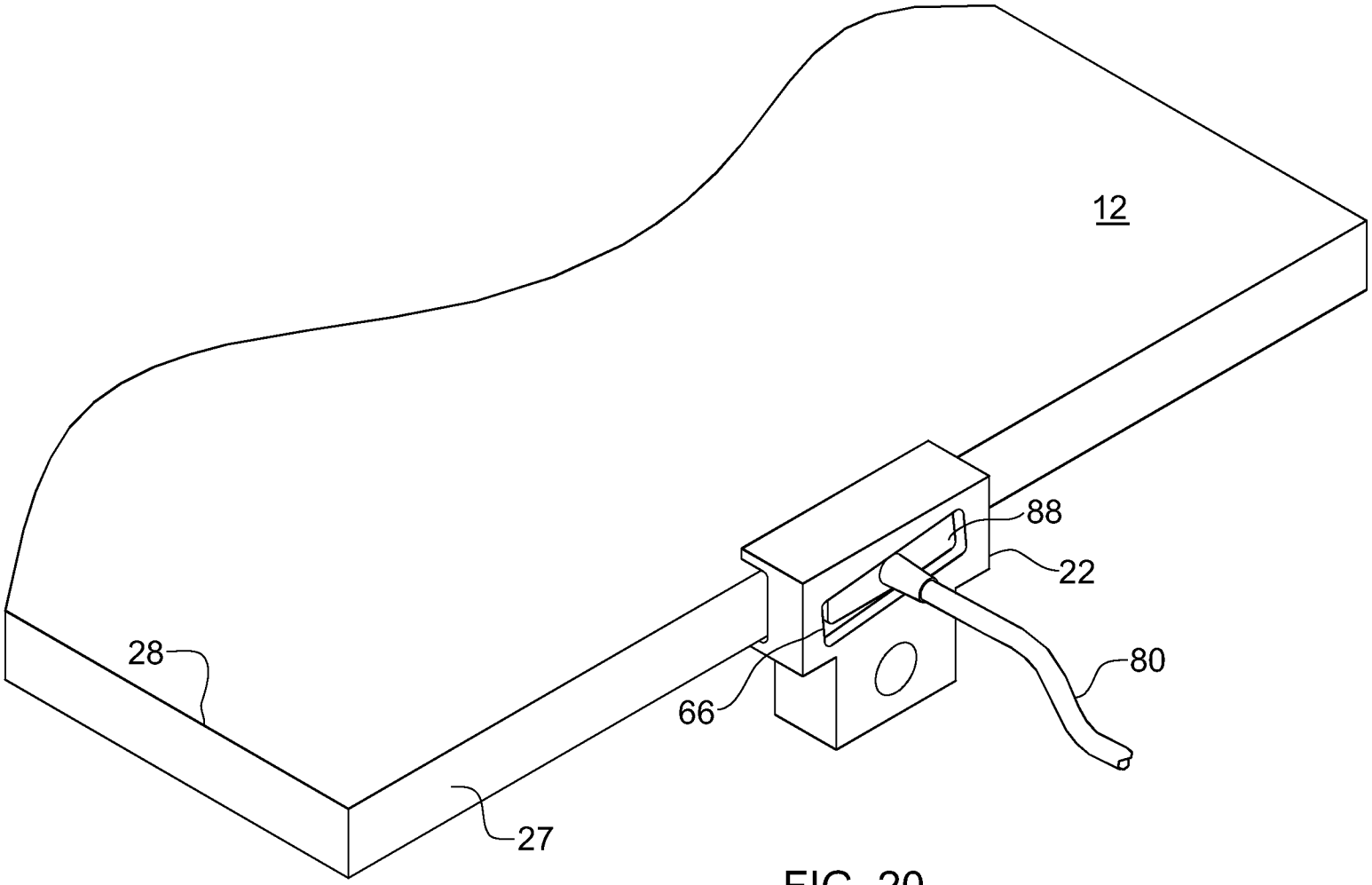
FIG. 20 is an assembled perspective view of the embodiment of FIG. 19, showing the securement device engaged to the device.
Figure 21B:
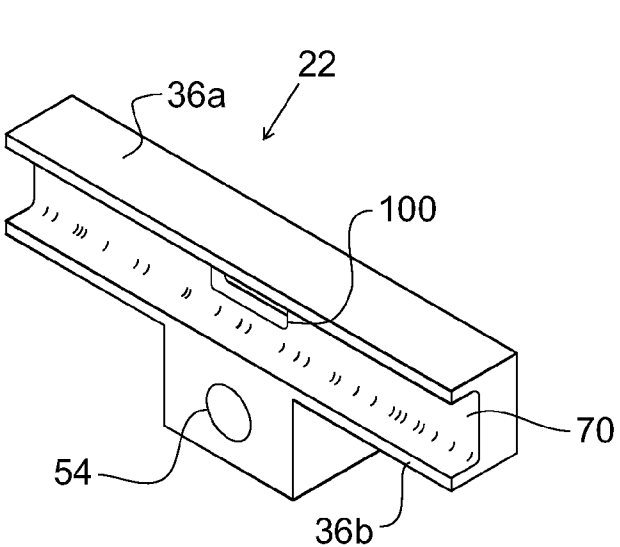
FIGS. 21A-B are front and back perspective views of an alternate embodiment of a securement device.
Figure 21A:
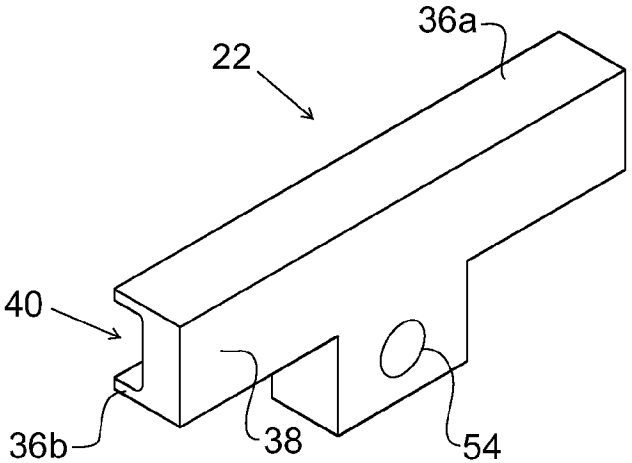
Figure 22B:
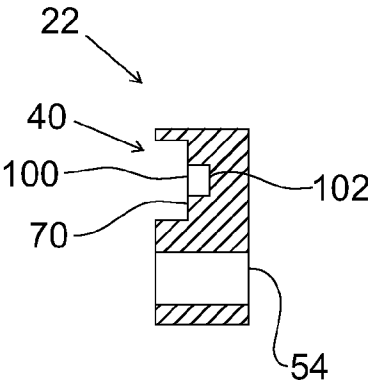
FIGS. 22A-B are a front plan view and a cross sectional view respectively of the embodiment of FIGS. 21A-B.
Figure 22A:
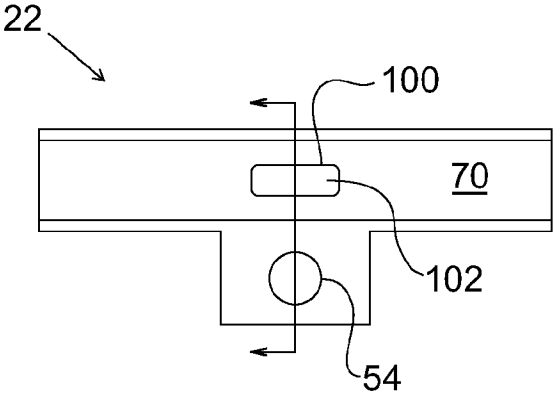

FIG. 19 illustrates the first bracket 22 embodiment of FIGS. 15-16 aligned with the first portion 27 of the item 12, with the first bracket 22 and the plug 82 ready to engage the first portion 27. A reference line 76 is drawn through the receptacle 84 on the item 12, where the line is approximately parallel with the longest sides of the receptacle 84. The same reference line 76 is drawn through the illustration of both the first bracket 22 and the plug 82 to demonstrate the angle 0 of the edge 92 of the plug aperture 66 relative to the receptacle.

To assemble the item 12, the first bracket 22, and the plug 82, the generally rectangular or elongated plug body 85 must be rotated and aligned with the plug aperture 66 in order to be inserted through the aperture. Thus, the user inserts the plug 82 through the plug aperture 66 when aligned. Then, draws the plug 82 and cable 80 through the plug aperture 66 and inserts the tip 86 of the plug 88 into the receptacle 84. The plug 88 and mating receptacle 84 can be one of numerous connectors, such as universal serial port (USB) connectors and connectors for mobile devices, such as the APPLE or SMASUNG 30-pin dock connector, the APPLE LIGHTNING connector, or other connectors that connect the device to one or more external resources for carrying various signals and power.

Once the plug 82 is inserted into the receptacle 84, the first bracket 22 can be coupled with the first portion 27 of the device 12. Either one or both of the top surface 74 and the bottom surface 72 engage the first portion 27 of the device 12 to align the first bracket 22 with the device, trapping the plug 88 between the first bracket 22 and the first portion 27 within the cavity 40. One or both of the top surface 74 and the bottom surface 72 contact the first portion 27 of the device to prevent rotation of the first bracket 22 relative to the first portion when engaged.

Because the plug aperture 66 is formed at an angle θ relative to the one or both of the top surface 74 and the bottom surface 72, the plug aperture 66 will also be situated at an angle relative to the receptacle 84. Thus, with the plug 82 inserted into the receptacle 84, the plug body 85 is misaligned with the plug aperture 66, such that the back end 88 of the plug 82 contacts one or more of the blocking portions 90 about the perimeter 96 of the plug aperture 66 when attempting to withdraw the plug 82 from the receptacle 84. As illustrated in FIGS. 2 and 3, when the elongated member 32 connects the first bracket 22 to the second bracket 24 in the secured configuration, with a lock attached to the second end 30 of the elongated member 32, the first bracket 22 is prevented from substantially separating from the second bracket 24. In the secured configuration the first bracket 22 mechanically interferes with removal of the plug 82 from the receptacle 84 due to the blocking portions 90 contacting a portion of the plug 82. The right wall 68 and the left wall 69 of the cavity 40 prevent lateral or side-to-side movement of the first bracket 22 relative to the device 12. The top surface 74 and the bottom surface 72 prevent rotation and up and down movement of the first bracket 22 relative to the device 12. And, the elongated member 32 connecting the first bracket 22 to the second bracket 24 prevents separation of the first bracket 22 to the second bracket 24. The embodiment of FIG. 17 works in a similar manner to the embodiment shown in FIGS. 15-16.

The embodiment illustrated in FIG. 18 discloses an alternate design of the plug aperture 66. Cables generally have two connectors or plugs, one on each end with a cord connecting the two. One plug may be larger than the other. For example, with the APPLE 30-pin connector to USB connector cable, the 30-pin connector plug is larger than the USB plug, where the 30-pin connector plug connects directly with the device and the USB plug connects with an external signal or power source. In this case, an alternate embodiment may include a plug aperture 66 which is sized too small to permit the larger 30-pin connector plug through, yet large enough to permit the USB plug to travel through the plug aperture 66. In this case, the USB plug is threaded through the plug aperture 66 of FIG. 18 from the cavity 40 side of the first bracket 22 and pulled through so that the larger 30-pin connector is within the cavity 40, yet unable to be pulled through the plug aperture 66. Thereafter, the 30-pin connector (illustrated as plug 82) is inserted into the receptacle 82; and the first bracket 22 is engaged to the first portion 27 of the item 12, to trap the plug 82 between the first bracket 22 and the first portion 27. In this way, the plug 82 is similarly prevented from withdrawal from the receptacle 84 due to being blocked by the blocking portions 90 about the perimeter edge 96 of the plug aperture 66.

Figure 23:
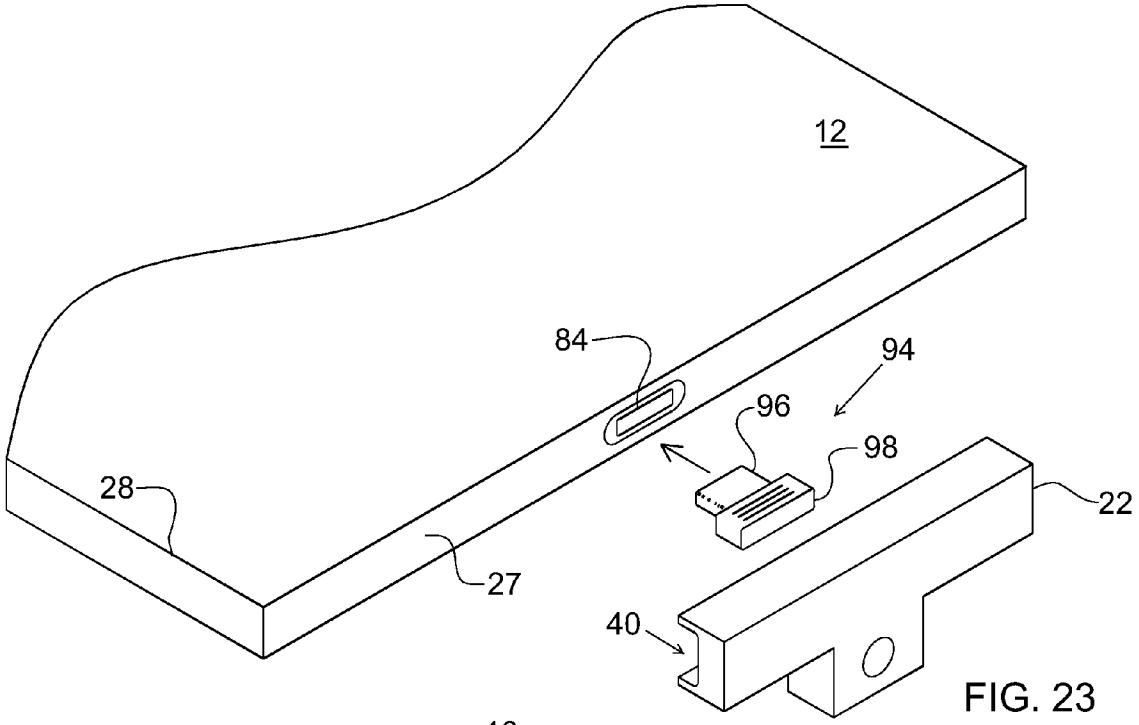
FIG. 23 is an exploded perspective view of the embodiment of FIGS. 21A-B, showing the securement device in position for engagement to a device.
Figure 24:
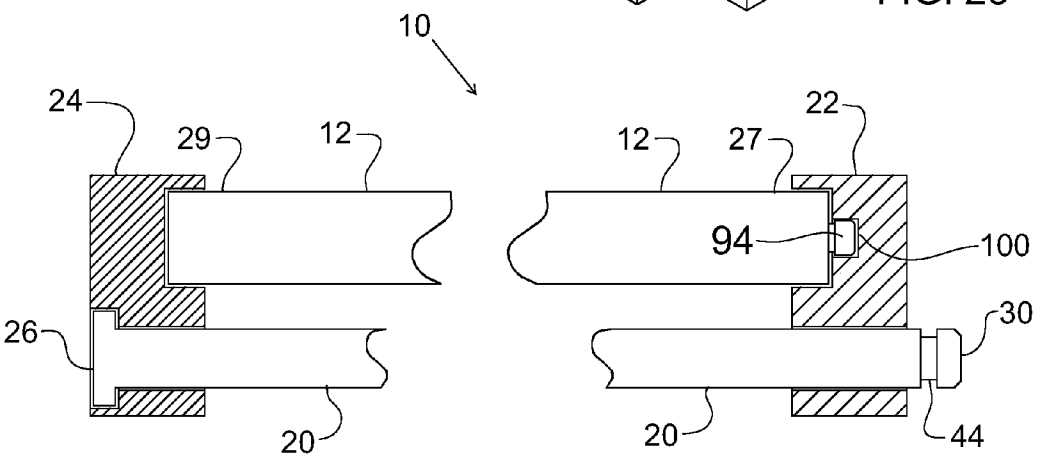
FIG. 24 is an assembled cross-sectional view of the embodiment of FIGS. 21A-B, showing the securement device assembled and engaged to the device.

FIGS. 21-24 illustrate yet another alternate embodiment of the present device, for use with attached devices 94 or other insert, such as a microUSB flash memory drive, a small dongle, a USB transceiver, receiver, transmitter, or similar low-profile devices which plug into the various power or data receptacles on the item 12. The first bracket 22, is similarly designed as the embodiments of FIGS. 16-20. However, instead of the plug aperture 66, there is a plug recess 100, which is preferably a blind hole with a bottom 102. Alternatively, the bottom 102 could be in the form of a shoulder or step in a through hole. The dimensions of the plug recess 100 are preferably sized slightly larger than the length and width of the attached device, which is received within the plug recess 100, as shown in FIG. 24. The depth of the plug recess 100, from the opening to the bottom 102 or bottom step, should be sufficiently deep to receive the body 98 of the attached device 94, but not so deep that the tip 96 of the attached device is permitted to fully withdraw from the plug receptacle 84. Thus, the depth of the plug recess 100 should be arranged such that the bottom 102 of the plug recess 100 blocks the attached device 94 from withdrawing from the plug receptacle 84 when in the secured configuration.

FIG. 23 illustrates the first bracket 22 with the plug recess 100 (hidden from view) aligned with the attached device 94 and the first portion 27 of the item 12, where the first bracket is ready to be engaged with the first portion 27. The tip 96 of the attached device 94 is then inserted into the plug receptacle 84; and the first bracket 22 is engaged to the first portion 27, with the body 98 of the attached device 94 situated within the plug recess 100. As with previous embodiments, the attached device 94 prevents left to right and up to down movement of the first bracket 22 relative to the item 12 in the secured configuration. FIG. 24 illustrates the first bracket 22 engaged with the first portion 27 of the item 12, the second bracket 24 engaged with the second portion 29, with the elongated member 20 spanning the item 12 to connect the first bracket 22 to the second bracket 24, ready for attachment or activation of a lock, pin, or other holding means to the second end 30 of the elongated member 20 to prevent separation of the first bracket 22 from the second bracket 24.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A securement device for securing an item having a first portion and a second portion, the item having a receptacle on the first portion for receiving in electrical contact a plug, the securement device comprising:

a first bracket having a wall with a plug aperture formed through the wall, a plug blocking portion being located about at least a portion of a perimeter of the plug aperture, the first bracket having a bracket portion adjacent to the wall;

a second bracket; and a connecting member for selectively connecting the first bracket to the second bracket;

wherein, in a secured configuration, the plug is inserted into the receptacle, the first bracket is engaged with the first portion and the second bracket is engaged with the second portion, the connecting member extends across the item to connect the first bracket to the second bracket, the connecting member preventing substantial separation of the first bracket from the second bracket;

and wherein the plug is prevented from being fully retracted from the receptacle due to being blocked by the plug blocking portion;

and wherein the bracket portion is configured to contact the first portion of the item when in the secured configuration to substantially inhibit rotational movement of the first bracket relative to receptacle on the item.

2. The securement device of claim 1, wherein the bracket portion is at least one of a top wall and a bottom wall.

3. The securement device of claim 2, wherein the bracket portion comprises the top wall and the bottom wall, the wall spanning between the top wall and the bottom wall and at least one of the top wall and the bottom wall contacts the first portion of the item when in the secured configuration to substantially inhibit rotational movement of the first bracket relative to receptacle on the item.

4. The securement device of claim 3, wherein the plug aperture has a perimeter edge, the perimeter edge being at an acute angle relative to at least one of the top wall and the bottom wall.

5. The securement device of claim 3, wherein the plug aperture has a perimeter edge, the perimeter edge being at a right angle relative to at least one of the top wall and the bottom wall.

6. The securement device of claim 3, wherein a left side wall is opposite a right side wall and both the left side wall and the right side wall are adjacent to each of the top wall, the bottom wall, and the wall, a cavity being defined by the top wall, bottom wall, wall, left side wall, and the right side wall.

7. The securement device of claim 6, wherein the cavity provides clearance for a plug body of the plug when in the secured configuration, at least one of the top wall, bottom wall, left side wall, and the right side wall substantially inhibiting lateral movement of the first bracket relative to the item.

8. The securement device of claim 6, wherein a cord extends from the plug and extends through plug aperture when in the secured configuration, a second plug being connected to a distal end of the cord, the second plug being smaller in size than the plug, the aperture being sufficiently sized to insert the second plug through the aperture, the aperture being insufficiently sized to insert the plug through the aperture, such that the plug cannot be inserted through the aperture.

9. The securement device of claim 1, wherein the plug blocking portion is a protrusion extending into the plug aperture from the perimeter.

10. The securement device of claim 1, wherein the plug blocking portion is a perimeter edge of the plug aperture.

11. A securement device for securing an item having a first portion and a second portion, the item having a receptacle on the first portion for receiving in electrical contact a plug with a plug body, the securement device comprising:

a first bracket having a wall with an inner surface and a plug recess formed on the inner surface, the plug recess having a bottom, the first bracket having a bracket portion adjacent to the wall;

a second bracket; and a connecting member for selectively connecting the first bracket to the second bracket;

wherein, in a secured configuration, the plug is inserted into the receptacle, the first bracket is engaged with the first portion and the second bracket is engaged with the second portion, the connecting member extends across the item to connect the first bracket to the second bracket, the connecting member preventing substantial separation of the first bracket from the second bracket;

and wherein the plug body is received within the plug recess in the secured configuration and is prevented from being fully retracted from the receptacle due to being blocked by the plug bottom;

and wherein the bracket portion is configured to contact the first portion of the item when in the secured configuration to substantially inhibit rotational movement of the first bracket relative to receptacle on the item.

12. The securement device of claim 11, wherein the plug recess closely surrounds the plug body and substantially inhibits lateral movement of the first bracket relative to the item.

13. The securement device of claim 11, wherein the first portion of the item is a first edge and the second portion of the item is second edge opposite the first edge.

14. The securement device of claim 1, wherein the first portion of the item is a first edge and the second portion of the item is second edge opposite the first edge.

15. A securement device for securing an item having a first portion and a second portion, the item having a cavity on the first portion, the securement device comprising:

a first bracket having a body with an extension extending from the body;

a second bracket; and a connecting member for selectively connecting the first bracket to the second bracket;

wherein, in a secured configuration, the first bracket is engaged with the first portion with the extension inserted within the cavity of the item, the second bracket is engaged with the second portion, the connecting member extends across the item to connect the first bracket to the second bracket, the connecting member preventing substantial separation of the first bracket from the second bracket;

and wherein the extension is received within the cavity in the secured configuration and is prevented from being fully retracted from the cavity due to the connecting member preventing separation of the first bracket and the second bracket.

16. The securement device of claim 15, wherein the extension is separable from the body of the first bracket and is received within one of an aperture or a recess.

17. The securement device of claim 16, wherein the extension is prevented from separating from the first bracket while in the secured configuration due to being blocked by a blocking portion on the first bracket.

* * * * *